US007380608B2

(12) United States Patent
Geier

(10) Patent No.: US 7,380,608 B2
(45) Date of Patent: Jun. 3, 2008

(54) PUMPING WATER FROM A NATURAL GAS WELL

(76) Inventor: Howard Geier, Box 25, SIte 3, R.R.#1, De Winton, Alberta (CA) T0L 0X0

( * ) Notice: Subject to any disclaimer, the term of this patent is extended or adjusted under 35 U.S.C. 154(b) by 147 days.

(21) Appl. No.: 11/298,946

(22) Filed: Dec. 12, 2005

(65) Prior Publication Data

US 2006/0124298 A1 Jun. 15, 2006

Related U.S. Application Data

(60) Provisional application No. 60/635,608, filed on Dec. 14, 2004.

(51) Int. Cl.
*E21B 43/00* (2006.01)

(52) U.S. Cl. ..... 166/369; 166/383; 417/904

(58) Field of Classification Search ..... 166/369, 166/72, 215.15, 68, 383; 417/904
See application file for complete search history.

(56) References Cited

U.S. PATENT DOCUMENTS 3,212,406 A * 10/1965 McDuffie ..... 91/165
4,125,163 A * 11/1978 Fitzpatrick ..... 166/250.03
5,447,026 A * 9/1995 Stanley ..... 60/372
5,996,688 A * 12/1999 Schultz et al. ..... 166/72

FOREIGN PATENT DOCUMENTS

| | | |
|---|---|---|
| CA | 2260518 | 8/1999 |
| CA | 2258237 | 7/2000 |
| CA | 2341129 | 9/2002 |

* cited by examiner

*Primary Examiner*—Jennifer H Gay
*Assistant Examiner*—David Andrews
(74) *Attorney, Agent, or Firm*—Adrian D. Battison; Michael R. Williams; Ryan W. Dupuis

(57) ABSTRACT

In a method for de-watering a gas well, the water is pumped by an inverted API pump acting as a reciprocating pump from a position in the well casing below the gas formation and the gas escapes through the well casing around the transport tubes. The reciprocating pump is driven by a downhole engine in the form of a cylinder and piston which is moved by a hydraulic pump at the surface acting to generate a flow in a hydraulic fluid to drive the piston from a start position to an end position and causing fluid to be transferred from the cylinder on the other side of the piston to a counterbalance chamber against a back pressure provided by a charge of nitrogen gas. At the end of a pumping stroke of the reciprocating pump, pressure in the hydraulic fluid from the hydraulic pump through is released to cause the back pressure of the counterbalance chamber to drive the piston back to the start position.

16 Claims, 4 Drawing Sheets

PUMPING WATER FROM A NATURAL GAS WELL

This application claims benefit of the date of filing under 35 U.S.C. 119 of Provisional Application 60/635,608 filed Dec. 14, 2004.

The invention relates in general to the field of artificial lift, well pumping systems and relates more specifically to designs meeting a unique set of economic criteria for equipment which can be deployed to de-watering shallow marginal natural gas wells.

BACKGROUND OF THE INVENTION

The unique design requirement of lifting water from economically marginal gas wells, flows from a user group planning meeting on Mar. 4, 2004. PTAC (Petroleum Technology Alliance of Canada) which issued a call for technical papers on the topic of de-watering marginal shallow gas wells, with the southeast Alberta, Brooks area shallow gas pools in mind. The PTAC forum was subsequently held in Calgary, Alberta, May 12, 2004. The transcripts and reaction comments arising from the forum are available to the public. Proposals submitted for funding assistance did not meet the collective needs of the planning group at a June 2004 deadline. To date producer needs are still being met using labour intensive frequent swabbing and/or endless tubing cleanouts.

Down-hole hydraulic pumps with the valving, piston and pump (and its variations) were originally developed under the trade names "Kobe" and "Oilmaster". Both have been available to the industry for more than five decades. The product enjoys worldwide acceptance under the current direction of Weatherford Oil Tool. These pumps find special application lifting large volumes of light oil in deep wells.

More recently Canadian application 2,258,237 by Cunningham suggested bringing the valving to the surface, and proposed using a downhole double acting hydraulic piston, three (3) strings of tube and a conventional oil well pump for placement in a horizontally drilled heavy oil well. The double acting feature of the hydraulic piston would be particularly useful as a pump pull-down in the highly viscous heavy oil applications for which the system was conceived.

Canadian application 2,260,518 proposes using a downhole rotary hydraulic drive, coupled to a progressing cavity pump rather than the reciprocating version suggested by the Cunningham application. Both address the task of pumping heavy oil in deviated well-bores.

While not detracting from the general applicability of this invention and claim(s) therein, it is useful to focus on a specific pumping system designed for de-watering marginal gas wells.

Data has not yet been made public, quantifying the increased cash value of recoverable gas reserves expected under pumped off de-watering conditions, as cited in Canadian application 2,341,129 by Nicholson.

SUMMARY OF THE INVENTION

According to one aspect of the invention there is provided a method of pumping material from a well comprising:

providing a hydraulic pump at the surface;

providing a downhole single acting cylinder having a piston therein;

providing a downhole hydraulic counterbalance chamber having back pressure;

providing a first transport tube from the hydraulic pump at the surface to the downhole cylinder;

providing a downhole pump for receiving and pumping the material;

providing a second transport tube from the downhole pump to the surface;

causing the hydraulic pump at the surface to transmit hydraulic fluid from the surface to the downhole cylinder on one side of the piston to drive the piston through a stroke from a start position to an end position and causing fluid to be transferred from the cylinder on the other side of the piston to be transferred to the counterbalance chamber against the back pressure;

causing the movement of the piston to drive a piston rod to actuate the downhole pump to pump the material;

and at the end of a pumping stroke of the downhole pump, causing the back pressure of the counterbalance chamber to drive the piston back to the start position.

Preferably the use of a dual tubing hydraulic well pumping system achieves a low energy consumption transfer of power down a well bore.

Preferably the hydraulically balanced "U" tube configuration requires that only a limited amount mass be moved to complete a pumping cycle, and it does so at low fluid friction loss compared to that required of conventional mechanical pumping.

Preferably the use of a downhole, gas over hydraulic oil counterbalance chamber eliminates the capital cost and space requirement of a third hydraulic tubular string.

Preferably the pump comprises an inverted compression stroke tubing rod pump directly connected to the piston rod of the downhole hydraulic piston.

Preferably the method is used for de-watering shallow, marginally economic gas wells wherein the material is water collected at the downhole pump and the gas escapes through the well casing around the first and second tubes.

An economically viable pumping system should meet or exceed these criteria:

A capital cost target of $C30,000 (high flow wells $C130,000)

Incremental operating cost ranging $C200-$C300/month

A low maintenance pump system, likely coil tubing conveyed

A new pumping power source, solar, wind, batteries or combinations of

Simple, low cost solution to deal with the water

Pump types which can handle abrasive solids in waters which range from those with some solids, all the way up to muddy colloidal suspensions (gummy).

The claims and equipment modifications embodied in this invention are considered capable of meeting and/or exceeding all except the last of the given criteria. Pumping well liquids containing abrasives has long been a problem for the industry. In this set of field operation conditions, solutions are required both in pump metallurgy and getting the sand to surface because of the low velocities associated with small volumes of water being lifted.

High energy consumption progressive cavity pumps are commercially available to pump high solids liquids, but in this case would defy most of the other given criteria. Operators will continue to rely on frequent swabbing and coil tubing foam cleanouts for the worst of the well cases. The equipment embodied in this invention partially addresses the problem, but is limited in application to wells producing clear to mildly abrasive waters.

The arrangement thus provides in general terms a novel means of transferring power down a well tube to a hydraulic/mechanical pump device, and lift produced water up a second tube in the well.

It does so at an unprecedented low level of system energy consumption. Solar/wind energy drive combinations become economically viable at current cost regimes.

It is useful to focus on a specific field pumping application to better convey the ideas embodied in the invention. To this purpose, we choose to describe applying the device to the task of de-watering shallow, marginally economic gas wells. The concepts do, however, have application in pumping other below ground liquids such as potable water and low viscosity crude oil.

The arrangement thus provides a dual tubing or concentric hydraulic well pumping system to achieve a low energy consumption transfer of power down a well bore. The hydraulically balanced "U" tube configuration requires that only a limited amount mass be moved to complete a pumping cycle, and it does so at low fluid friction loss compared to that required of conventional mechanical pumping.

The arrangement thus provides a downhole, free piston oil over gas counterbalance chamber, thus eliminating the capital cost and space requirement of a third hydraulic tubular string.

The arrangement thus provides an inverted compression stroke tubing rod pump directly connected to a downhole hydraulic piston engine apparatus.

Preferably the two tubes are arranged with an inner one inside an outer one. Although a parallel arrangement can also be used.

This concentric arrangement allows the two tubes to be run into the gas well with the outer tube passing through a lubricator while the well is under pressure, thus avoiding the requirement to "kill" the well using water back flow.

In a particularly advantageous arrangement the reciprocating pump is an inverted API pump since this can accommodate the influx of some gas with the liquid without gas lock up of the pump.

According to a second aspect of the invention there is provided a method of pumping liquid from a first location to a second location comprising:

providing a hydraulic pump at the second location for generating a flow of hydraulic fluid under pressure;

providing a first transport tube extending from the hydraulic pump at the second location to the first location;

providing at the first location a reciprocating pump operable in response to the supply of hydraulic fluid for receiving and pumping the liquid;

providing a second transport tube from the reciprocating pump at the first location to the second location;

wherein there is provided a sensor for measuring pressure in the first transport tube and wherein changes in the pressure are used to detect when there is insufficient liquid in the reciprocating pump during a pumping stroke to avoid pumping when no liquid is present.

BRIEF DESCRIPTION OF THE DRAWINGS

One embodiment of the invention will now be described in conjunction with the accompanying drawings in which.

DETAILED DESCRIPTION

Figure 1:
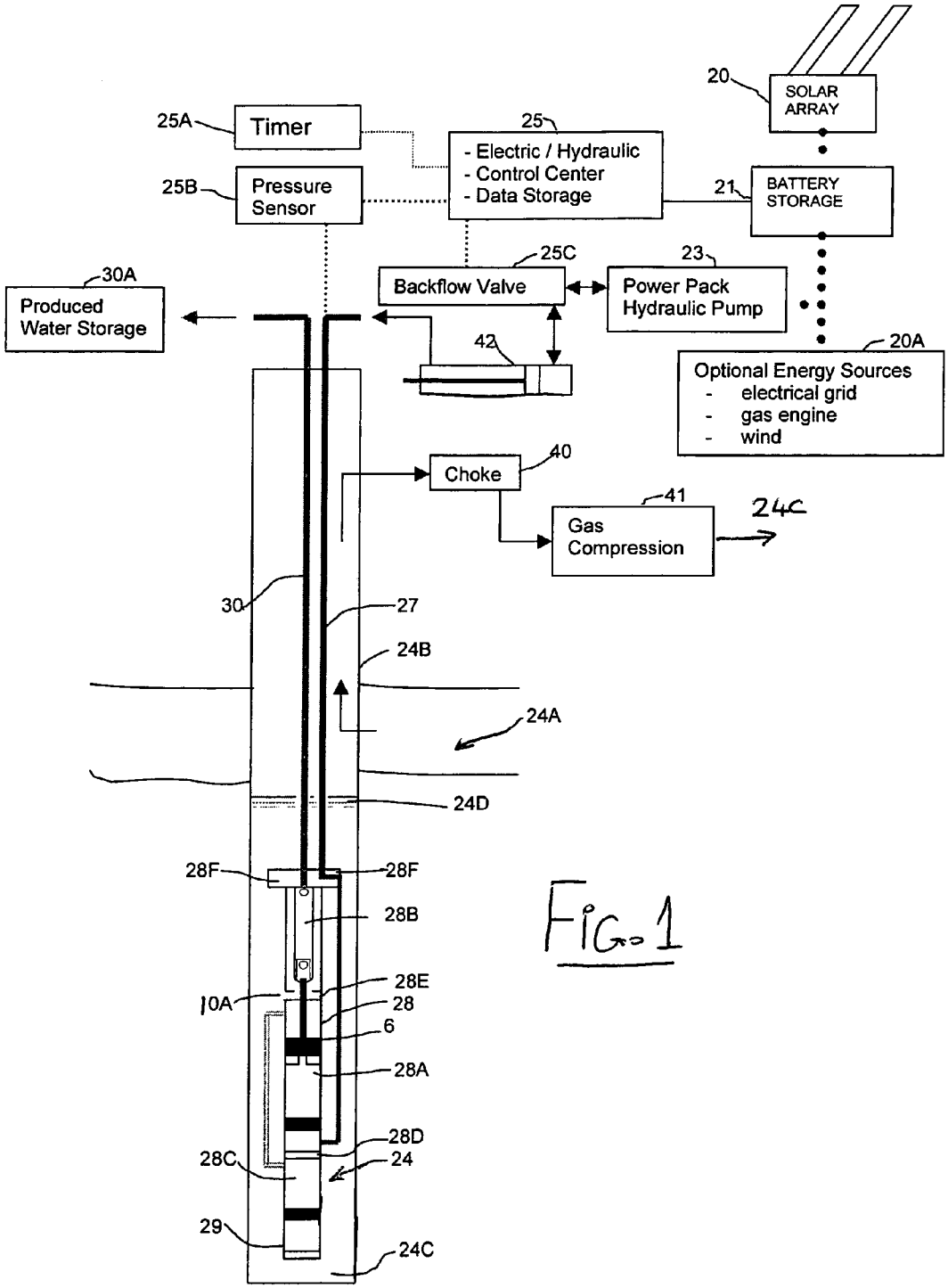
FIG. 1 is an overview of a system according to the invention which is used for pumping waste water from a gas well, the system including dual parallel string arrangement.
Figure 3:
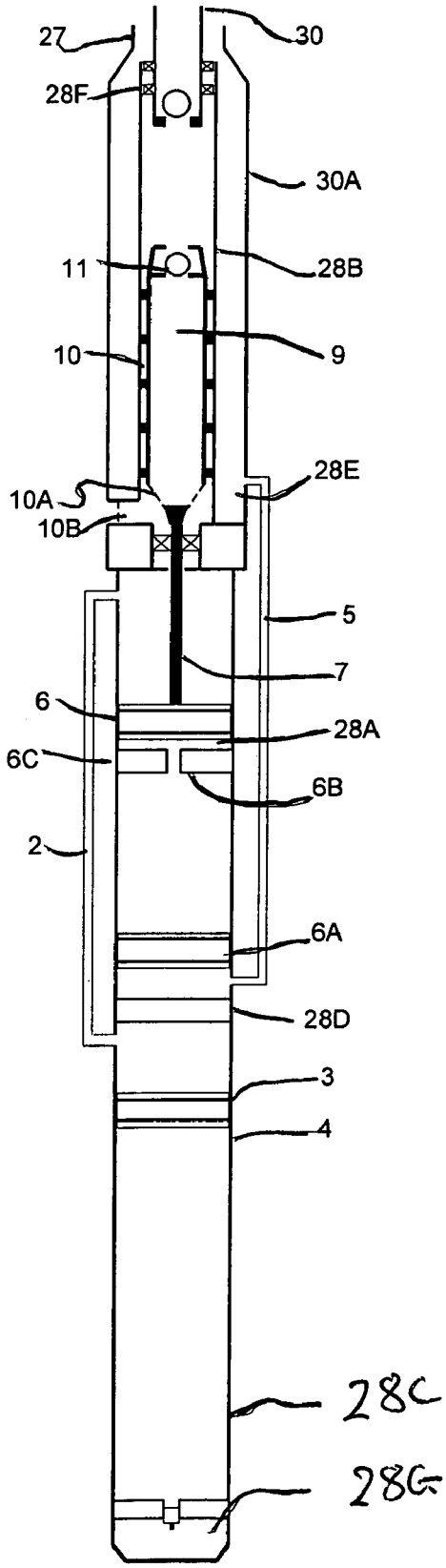
FIG. 3 is a longitudinal cross-sectional view of the downhole components of the system of FIG. 1, the system being modified to include a dual concentric string arrangement.
Figure 4:
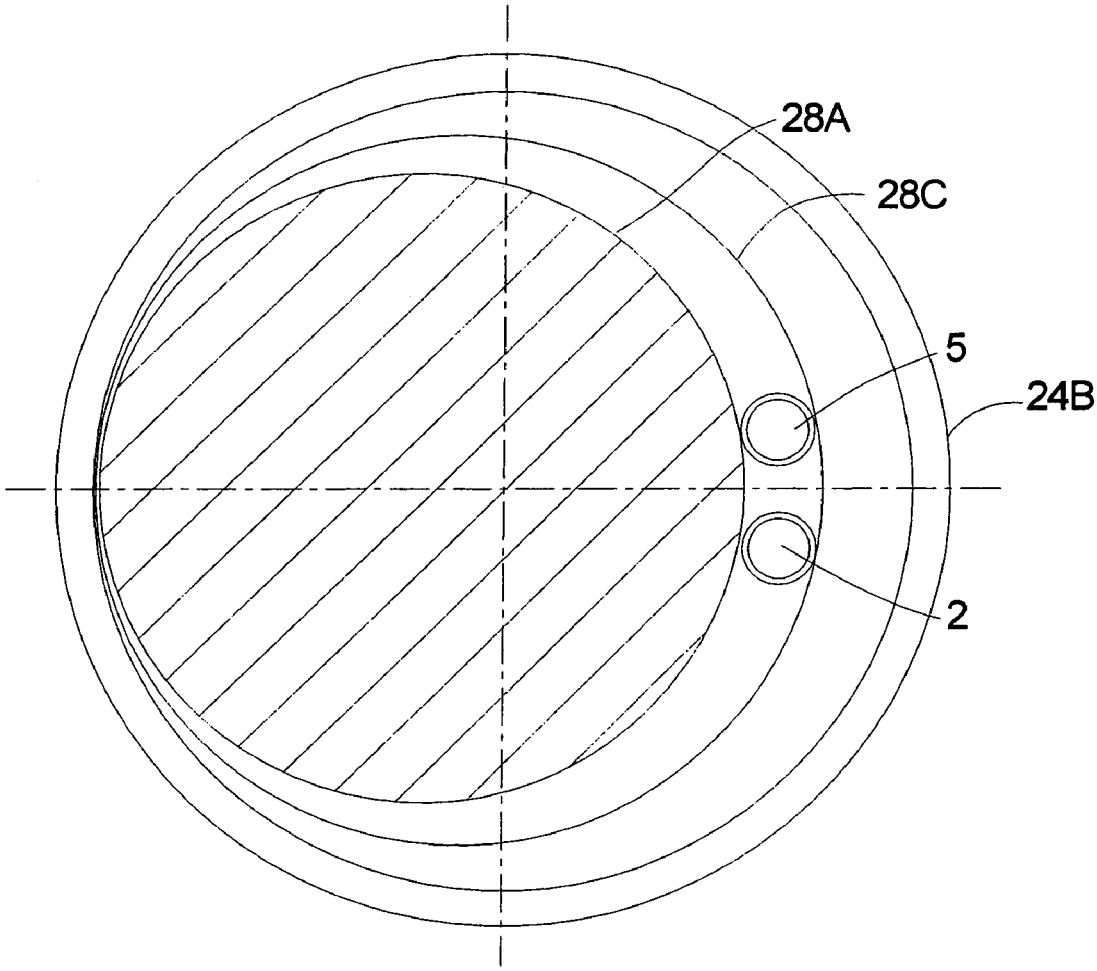
FIG. 4 is a transverse cross-sectional view of the downhole components of the system of FIG. 1.

As shown in FIGS. 1, 3 and 4 there is provided an apparatus for pumping water from a gas well.

The gas well is generally indicated at 24 and includes a gas formation 24A and a well casing 24B for transporting that gas to the surface for collection in conventional manner. The structure of the well casing and the gas formation are shown only schematically as these are well known to a person skilled in the art.

As is well known, water tends to collect at a lower end 24C of the well casing which can increase in depth to a situation where the water interferes with the production of gas from the formation 24A. The intention is that the water level be maintained below the gas formation at a water level 24D.

A pumping system for removing the water at low energy consumption includes a downhole system 28. defined by section 29 which communicates through first and second transport tubes 27 and 30 to the surface. First transport tube 27 connects to a hydraulic pump 23. The hydraulic pump 23 is controlled by a control unit 25 which includes inputs 25A from a timer and 25B from a pressure sensor connected to the first transfer tube 27 and therefore responsive to the pressure within that tube. The second transfer tube 30 transports the pumped water to a water storage system 30A. Electric power for the hydraulic pump is supplied from a battery storage system 21 which is powered by a solar array 20 and/or by other power systems 20A. The other power systems generally are of a nature which uses relatively low level of energy and particularly a low level of purchased energy so that recycling system such as wind energy can be used.

The downhole system 28 includes a hydraulic piston 28A, a pump 28B driven by the cylinder and a counter balance chamber 28C connected to the cylinder. These components are formed by cylindrical housings connected end to end in a row so that the cylinder 28A is located between the pump 28B and the counter balance chamber 28C. The cylindrical components are connected together by connectors thus providing a first connector sub 28D between the cylinder 28A and the counter balance chamber 28C, a second connecting sub 28E between the cylinder and the pump and a third connecting sub 28F connecting between the top of the pump and the transfer tubes 27 and 30.

In general the system operates by the hydraulic pump 23 generating pressure in a hydraulic fluid which is supplied through the transport tube 27 to the cylinder 28A. This cylinder 28A contains a piston 6, as shown in FIG. 3, so that the supply of fluid to the underside of the piston 6 through the tube 5 acts to drive the piston upwardly. A piston rod 7 communicates the upward movement to a pump piston 9 within a cylinder 10 of the pump 28B. Thus supply of the fluid through the tube 27 drives the pump upwardly to push collected water from the cylinder 10 into the tube 30 for transfer to the surface.

Meanwhile fluid from the upper side of the cylinder 28A is transferred to the counter balance chamber 28C through a pipe 2. Within the counter balance chamber 28C is provided a gas chamber so that supply of the hydraulic fluid from the cylinder 28A into the counter balance chamber 28C compresses the gas to form a back pressure which increases as the piston 6 moves along the cylinder 28A.

In general when the piston 6 reaches the upper end of its stroke thus completing the stroke of movement of the pump piston 9, the hydraulic pump 23 is closed off and the valve 25C actuated to release the pressure in the transfer tube 27. This release of pressure allows the back pressure in the counter balance chamber 28C to return the fluid to the upper part of the cylinder 28A thus returning the piston 6 and the pump piston to the initial position for a further subsequent stroke.

The transfer of fluid from the hydraulic pump to the cylinder 28A requires little movement of hydraulic flow and the return stroke of the cylinder merely acts to return the same level of fluid back to the surface. The amount of fluid therefore pumped is very low in order to achieve each single stroke of the pump.

Figure 2:
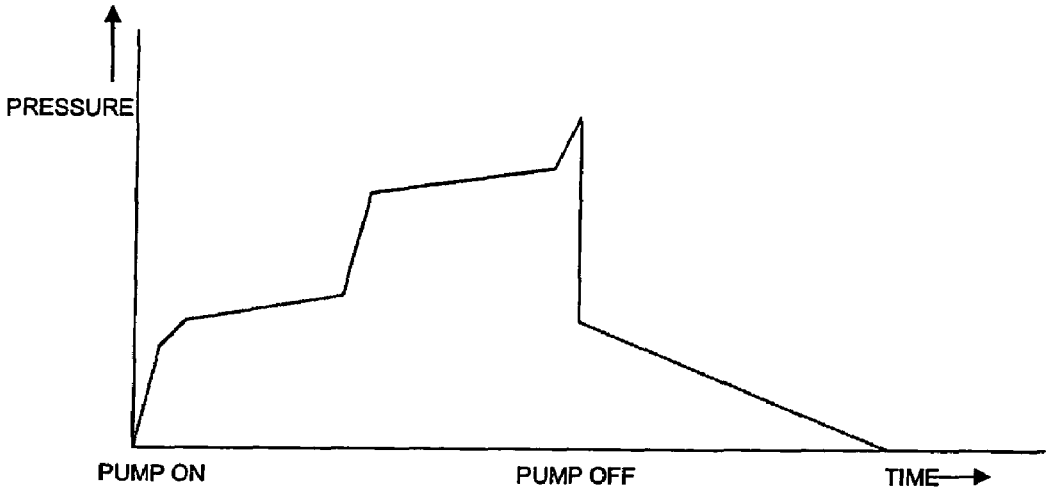
FIG. 2 is a theoretical graph of pump pressure.

With reference to FIGS. 1 and 2, the solar array 20 may be used to recharge the storage batteries 21 during daylight hours. Power demand by the hydraulic pump 23 from a solar source is limit to 3 hours per day in winter operation, but is extended by using other choices of power (electrical grid, wind, engine drive) and/or daily on-time setting. The concept of downhole pumping using a hydrostatically balanced "U" tube system, and tube sizing for low friction loss laminar flow, typically leads to less than a 2 horsepower energy draw during each 1.5 minute stroke of the downhole cylinder 28A and direct coupled to the one (1.3) liter plunger pump 28B. Many marginal gas wells load up with less than 1 cu. meter of water in two weeks of production.

The control unit 25 groups the adjustable instrument systems and data gathering in an explosion proof well site enclosure. Pump motor start/stop and controlled pressure bleed back of the hydraulic oil each pumping cycle is located in this enclosure. The control unit includes a micro controller which additionally stores data for retrieval.

On signal, the hydraulic power pack 23 pumps hydraulic fluid down the primary coil tubing string 27 which may be for example a 1" (25.4 mm) tube to initiate an up-stroke of the downhole hydraulic piston 28A. Hydraulic fluid trapped above the engine piston is stored at increasing pressure in the nitrogen gas filled counterbalance chamber 28C. At the same time, the direct coupled plunger piston and traveling valve above the engine, forces produced water to the surface through a secondary coil tubing string 30 which may be for example a 1¼" (31.8 mm) tube. The standing and traveling valve arrangement in the plunger pump 28B accommodates the pumping action.

The pump is shut down and a controlled pressure bleed-back at the surface is initiated when the surface control system senses the "pressure spike" of the downhole engine piston reaching the top of its stroke. Depending on pre-selected cylinder area ratios and stroke length, a given pump system may typically produce 1.5 liters of formation water per cycle. The low energy requirement and engineered well system supports the investment and operating cost criteria of dewatering marginal gas wells.

Referring now to FIGS. 3 and 4, the sub-surface pumping system consists of the three cylindrical chambers 28B, 28A and 28C stacked one on top another, sized to fit a given well casing internal dimension. Each is connected to the other by threaded subs 28D, 28E and 28F. Each sub is internally ported to accommodate various fluid passages. Hydraulic fluid moves to and from these ports through external high-pressure tubes. Looking down the well casing on a plan view, FIG. 4 shows how one such pumping assembly is arranged eccentrically to fit in a slim-hole 4½" (114.3 mm) casing 24B.

The entire sub-surface pump assembly is pre-charged with pressurized nitrogen, purged of air pockets trapped in the cylinders and lowered to well setting depth attached to the outer coil steel tubing string 27.

The lowest of the three cylinders, namely the counter balance chamber 28C is constructed with an external tube 2 so as to carry pressurized hydraulic oil from top of the chamber 28C past Sub 28D, and thence externally to the top of the piston area shown in the cylinder 28A. The sub 28G seals the bottom of the counter balance chamber 28B In the arrangement shown in FIG. 3, the fluids are conveyed into and from the gas well using concentric, not parallel coiled tubes 27 and 30. Thus the tube 30 surrounds the tube 27 and includes an expanded portion 30A which surrounds also the pump in the sub 28B and connects to the sub 28E. This communicates the hydraulic fluid under pressure to the sub 28E which then conveys it through the tube 5 to the bottom of the sub 28A underneath the piston 6. A barrier cylinder free piston 6A is provided on top of the fluid supplied through the pipe 5 so as to separate the fluid from a charge of oil between the free piston 6A and the piston 6. A stop 6B in a further sub 6C acts to limit the movement of the piston 6A. Thus a "water back to oil" barrier cylinder and free piston section is provided below the engine, that is the cylinder 28A and the piston 6 in that cylinder.

The accumulator section 28C has a free piston 3 separating the fluid from the engine supplies through the tube 2 from the nitrogen gas. Thus the piston 3 defines a chamber which contains the $N_2$ gas when the tool is in the horizontal transport position.

A produced water inlet 10A is provided at the bottom of the cylinder 10 and is covered by an engineered sand screen 10B of known technology at the intake ports.

A seal mandrel 27A of known technology for the produced formation water coil tube 27 is provided at the connection between the tube 27 and the top of the cylinder 10 or the reciprocating pump.

The nitrogen gas cushion is added at the surface. The pressure used in the cushion 4 is a technical calculation based on the hydrostatic pressure head in the hydraulic power oil tube 5 plus 15% for over-pressure to bottom out the engine piston after each power stroke.

The cylinder 28A includes the double acting hydraulic cylinder piston 6 and piston rod 7 which are constructed to seal under high internal pressure 2,000 psi (14,000 kpa) both inside the tube and at the sub 28E through which the rod passes.

When the time delay relay in the surface control system signals the start of a new pumping cycle, hydraulic flow down the primary coil tubing string 27 transfers pressure energy to the engine piston 6 in the lower section of the cylinder 28A. At the instant this applied flow pressure overcomes the forces of fluid flow friction, pressure ballooning in the tube and compression of the 15% over-pressure preload in the nitrogen cushion 4, the engine piston 6 will travel upward. Hydraulic liquid in the area above the engine piston 6 will be returned to storage through the pipe 2 under increasing pressure in the counter balance chamber 4. The piston rod 7 carried by the piston 6 moves the plunger 9 in the pump chamber tube 10 in a vertical compression stroke so as to force accumulated well fluids collecting in the chamber 10 into the outer coil tubing string 30 and up to surface.

An elastomer rod seal is positioned at sub 28E to wipe abrasive solids from the exposed portion of the piston rod 7. The power stroke is ended when both the engine piston 6 and the pump plunger 9 "top out" in their respective tubes. The pressure spike in the liquid system is sensed back at the surface by sensor 25B. The pressure switch instrument device shuts the hydraulic pump off, and at the same time opens the valve 25C which forms a pressure bleed-back solenoid valve loop. The controlled pressure bleed-back part of the pumping cycle begins as shown in the data chart displayed in the FIG. 2.

The pump 28B is a modified traveling barrel API (American Petroleum Institute) sucker rod pump, common to the oil industry. Arranging the pump for a compression type upstroke is unique in an arrangement of this type. The plunger pump is, in itself, a precision hardened and honed tool, capable lifting well liquids to surface at high hydrostatic pressure. The hollow plunger 9 is an elongated version of the shorter hydraulic piston 6 situated below. The "soft pack" seals on the pump plunger serve to prolong run life in a somewhat un-lubricated and abrasive well fluid pumping environment. During the controlled pressure bleed back at the surface, a standing valve 13 in the oil well pump chamber closes so as to prevent a back-flow of the water from the coil tube string 30. At the instant when pressure, both above and below the engine piston 6 is "balanced", the plunger moves slowly downward. When a void space is created above the pump plunger valve 11, well fluids (both liquids and some gas) flood into pump intake ports 10A, up through the hollow plunger tube interior, and into the void.

While conventional top stroking rod pumps often "gas lock", given any liquid entry at all, the inverted API pump is inherently superior at compressing gas. Gas lock is routinely cleared by this construction.

The system disclosed herein thus provides a technique for pumping water to the surface where the power requirements are sufficiently low to allow in some cases the use of solar energy and in other cases to make economically viable what might otherwise be wells which are uneconomical. One technique to yet further reduce the power consumption is to tailor the pumping action to expected requirements by timing the pumping strokes to what is in effect the minimum allowable to maintain the water levels at the required position below the gas formation. Another technique is to halt the pumping action when dry strokes are encountered. A dry stroke, that is where the pump chamber is filled wholly with gas without any water, can be detected by sensing the pressure profile during the pumping stroke. Thus in the presence of liquid, the pressure will rise rapidly when the hydraulic pump is turned on due to the presence of the incompressible liquid. In the absence of liquid the pressure profile will rise but more slowly as the gas in the pump cylinder is compressed. The dry stroke can be dealt with in different ways.

First setting is called the "fixed timeout". During the normal strokes, the controller is able to sense the dry stroke (by comparing the downhole pressure). Then, the controller will perform a "fixed" timeout period. This timeout period will be much longer than the normal stroke period. For example, if the normal period is 4 minutes, the timeout period will be 2 hours; if the normal period is 1 hour, the timeout period will be 6 hours. This timeout period needs to be preset.

Second setting is called the "dynamic timeout". Again, the controller will be sensing the downhole pressure, yet, for this setting, there will be a couple of different timeout periods stored in the controller. Based on different downhole pressure and the characteristics of the well, the controller will select the best timeout period. For example, if the normal period is 4 minutes, the timeout period could be 1 hour, 2 hours or 3 hours. The controller will select the best timeout period.

The control unit can also be arranged to carry out the following actions:

Stage 1, Sense the "Cut-Off" Pressure.

The controller just acts as an On/Off timer switch. When the pressure is higher than the cut-off pressure, stop the pump, and count down for a "wait period", then starts the pump again.

Stage 2, Real Time Monitoring

The controller is connected to a computer. Real time pressures are display at the computer. All data are stored into the computer.

Stage 3, 24 Hours Timer (or 1 Year Timer)

A 24 hours timer is added. We will be able to setup the system pumps at day time. (When the sun is shinning) For example, the pump starts at 7 am and stops at 6 pm during summer time.

It can be easily programmed to have 1 year timer into the controller. In this case, the controller will change the start time according to the month and the day.

Note: the system does not necessarily run only in the day time. It can be operated 24 hours and keep pumping water out.

Stage 4, Low Voltage Cut-Off

To protect the system from running with low battery charge levels, the controller will stop the pump. The timer and controller are still running, but it will not send the "ON" signal to the pump. The system will run normally when the battery is 80% charged.

Stage 5, Dry Stroke Prevention

To protect the pump, there will be 2 ways to prevent pumping a dry stroke. With the fixed timeout, the timeout period is set, the pump will stop for a fixed period of time. With the dynamic timeout, the controller selects a timeout period based on the pressure and the character of that well.

Stage 6, Record Gas Production and Set Data Remotely

Another sensor can be provided as indicated at 24C to record the gas production on the well. And adding a function to send the gas production and pumping pressure back to the office remotely. In this case, the system can monitor the performance of the pump.

The concentric two tube configuration, will be run into the gas well through a lubricator (not shown) under pressure. Thus the well will not have to be "killed" with load water. Possible formation damage will be averted. Other systems are not able to do this.

As shown in FIG. 1 there is provided at the surface a choke 40 for the produced gas which is supplied to a compression stage 41. Also a well isolation cylinder 42 serves as a pressure safety device, a stroke indicator and a surface "oil to water" power fluid interface divide.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of pumping liquid from a first location to a second location comprising:

providing a hydraulic pump at the second location for generating a flow of hydraulic fluid under pressure;

providing at the first location a cylinder having a piston therein;

providing at the first location a hydraulic counterbalance chamber having back pressure therein;

providing a first transport tube extending from the hydraulic pump at the second location to the cylinder at the first location on one side of the piston therein;

providing at the first location a reciprocating pump for receiving and pumping the liquid;

providing a second transport tube from the reciprocating pump at the first location to the second location;

causing the hydraulic pump at the first location to generate a flow of a volume of the hydraulic fluid through the first transport tube to the cylinder at the second location on one side of the piston to drive the piston from a start position to an end position;

causing fluid to be transferred from the cylinder on the other side of the piston by movement of the piston to the counterbalance chamber against the back pressure where the transferred fluid is stored under the back pressure;

causing the movement of the piston to drive the reciprocating pump through a pumping stroke to pump the liquid into the second transport tube for transportation to the second location;

and at the end of a pumping stroke of the reciprocating pump, releasing pressure in the hydraulic fluid from the hydraulic pump through the first transport tube to the cylinder so as to cause the back pressure of the counterbalance chamber to return the stored fluid under the back pressure back to the cylinder so that the back pressure acts to drive the piston back to the start position;

and arranging the piston and the first transport tube such that the movement of the piston acts to force said volume of hydraulic fluid from the cylinder back through the first transport tube.

2. The method according to claim 1 wherein there is provided a sensor for measuring pressure in the first transport tube and wherein changes in the pressure are used to detect when the piston reaches the end position.

3. The method according to claim 1 wherein there is provided a sensor for measuring pressure in the first transport tube and wherein changes in the pressure are used to detect when there is insufficient liquid in the reciprocating pump during a pumping stroke to avoid pumping when no liquid is present.

4. The method according to claim 1 wherein the reciprocating pump, the cylinder and the counterbalance chamber are arranged in a row connected by subs.

5. The method according to claim 1 wherein the reciprocating pump, the cylinder and the counterbalance chamber are arranged to define a cylindrical body with connecting pipes on an exterior of the body.

6. The method according to claim 1 wherein the back pressure in the counterbalance chamber is provided by a gas in chamber which is compressed during the pumping stroke.

7. The method according to claim 1 wherein there is provided a valve at the first location such that the pressure is released from the first location.

8. The method according to claim 1 wherein there is provided a valve at the end of the second transport tube at the reciprocating pump to prevent back flow of the liquid to the reciprocating pump.

9. The method according to claim 1 wherein the reciprocating pump has an outlet at one end to the second transport tube and an intake for the liquid from around the pump on an opposite end and wherein the liquid from the intake passes through a valve in a pumping piston in the reciprocating pump.

10. The method according to claim 1 wherein the reciprocating pump comprises an inverted compression stroke tubing rod pump directly connected to a piston rod of the piston of the cylinder.

11. The method according to claim 1 when used in a well wherein the first location is at the ground surface at the well and the second location is at a bottom of the well.

12. The method according to claim 11 wherein there is provided a control unit at the surface for controlling from the surface operation of the hydraulic pump and the release of pressure from the second transport tube.

13. The method according to claim 1 when used for de-watering a gas well having a well casing wherein the liquid is water which is pumped by the reciprocating pump from a position in the well casing below the gas formation and the gas escapes through the well casing around the first and second transport tubes.

14. The method according to claim 1 wherein the first and second tubes are arranged with an inner one inside an outer one.

15. The method according to claim 14 wherein the first and second tubes are run into the gas well with the outer tube passing through a lubricator while the well is under pressure.

16. The method according to claim 1 wherein the reciprocating pump is an inverted API pump.

* * * * *